US007054457B2

(12) United States Patent
Saltykov

(10) Patent No.: US 7,054,457 B2
(45) Date of Patent: May 30, 2006

(54) HEARING INSTRUMENT RECEIVER MOUNTING ARRANGEMENT FOR A HEARING INSTRUMENT HOUSING

(75) Inventor: Oleg Saltykov, Fairlawn, NJ (US)

(73) Assignee: Siemens Hearing Instruments, Inc., Piscataway, NJ (US)

( * ) Notice: Subject to any disclaimer, the term of this patent is extended or adjusted under 35 U.S.C. 154(b) by 173 days.

(21) Appl. No.: 10/218,013

(22) Filed: Aug. 13, 2002

(65) Prior Publication Data

US 2003/0179897 A1 Sep. 25, 2003

Related U.S. Application Data

(60) Provisional application No. 60/365,930, filed on Mar. 20, 2002.

(51) Int. Cl.
*H04R 25/00* (2006.01)

(52) U.S. Cl. ..... 381/328; 381/322; 381/324; 381/380; 381/382

(58) Field of Classification Search ..... 381/328, 381/325, 329, 322, 309, 71.6, 324, 327, 370, 381/380, 382; 181/129, 130, 135
See application file for complete search history.

(56) References Cited

U.S. PATENT DOCUMENTS

| | | | | |
|---|---|---|---|---|
| 4,412,096 | A | 10/1983 | Edgerton et al. | 381/60 |
| 4,870,688 | A | 9/1989 | Voroba et al. | 381/60 |
| 5,002,151 | A | 3/1991 | Oliveirs et al. | 181/130 |
| 5,146,051 | A | 9/1992 | Hermann | 181/130 |
| 5,166,659 | A | 11/1992 | Navarro | 381/68.6 |
| 5,185,802 | A | 2/1993 | Stanton | 381/68.6 |
| D340,286 | S | 10/1993 | Seo | D24/174 |
| 5,487,012 | A | 1/1996 | Topholm et al. | 364/474.05 |
| 5,609,164 | A | 3/1997 | Dyrud et al. | 128/864 |
| 5,881,159 | A | 3/1999 | Aceti et al. | 381/328 |
| 5,887,070 | A * | 3/1999 | Iseberg et al. | 381/380 |
| 6,205,227 | B1 | 3/2001 | Mahoney et al. | 381/328 |
| 6,283,915 | B1 | 9/2001 | Aceti et al. | 600/300 |
| 6,292,572 | B1 | 9/2001 | Yoest et al. | 381/322 |
| 6,367,578 | B1 | 4/2002 | Shoemaker | 181/135 |
| 6,393,130 | B1 | 5/2002 | Stonikas et al. | 381/322 |

OTHER PUBLICATIONS

International Search Report, Abstract CH684231 "Hearing Aid to be worn in the auditory canal of a person".

* cited by examiner

*Primary Examiner*—Curt Kuntz
*Assistant Examiner*—Tuan Duc Nguyen
(74) *Attorney, Agent, or Firm*—Alexander J. Burke; Mark H. Jay

(57) ABSTRACT

A hearing instrument and method of assembly are disclosed. The hearing instrument comprises an electronic assembly for providing received sound to the ear canal of a hearing instrument user. The electronic assembly is placed within a chamber in a housing sized to fit within the ear of the hearing instrument user. The chamber includes an internal guide channel and mounting surface for locating and positioning the electronic assembly. A volume encompassed within a hearing aid housing may be analyzed, such as with computer software, to identify a location within the chamber to position the electronic assembly, and then the electronic assembly may be incorporated into the housing using a guide channel and mounting surface of the housing for locating and positioning the electronic assembly in the identified location.

14 Claims, 5 Drawing Sheets

HEARING INSTRUMENT RECEIVER MOUNTING ARRANGEMENT FOR A HEARING INSTRUMENT HOUSING

This application claims priority to U.S. Provisional Application Ser. No. 60/365,930 filed Mar. 20, 2002, entitled "Hearing Aid Instrument and Related Production Process."

FIELD OF THE INVENTION

The present invention relates to the field of hearing instruments.

BACKGROUND OF THE INVENTION

Hearings instruments may be inserted either partially or completely into a user's ear canal. Typically, hearing instruments, especially custom hearing instruments, must be constructed to minimize feedback when deployed in the user's ear canal.

Existing construction methods and structures for custom hearing instruments do not allow consistent feedback performance and typically require many iterations during manufacture to position an electronic assembly inside a housing of the hearing instrument before a satisfactory performance is achieved, e.g. with respect to feedback.

Often, a closing procedure is done by a trial and error method with an assembly worker moving the electronic assembly within the housing chamber to try to achieve feedback-free operation. Such a procedure may take a significant amount of time. Further, there is no guarantee that the performance will be satisfactory, e.g. possible spikes on a frequency response may still exist because of internal feedback.

SUMMARY OF THE INVENTION

A hearing instrument for positioning in the ear of a user comprises an electronic assembly which is useful in processing and providing processed sound for output into an ear canal of a hearing instrument user when placed within a housing sized to fit within the ear of the hearing instrument user. The housing includes an internal guide channel and a mounting surface for locating and positioning the electronic assembly.

The disclosed construction and assembly method a hearing instrument provides consistent results for assembly of the hearing instrument. A volume, e.g. a chamber, encompassed within the hearing instrument housing may be analyzed, such as with computer software, to identify a location within the chamber to position the electronic assembly, and then the electronic assembly may be incorporated into the housing using a guide channel and mounting surface of the housing for locating and positioning the electronic assembly in the identified location.

The scope of protection is not limited by the summary of an exemplary embodiment set out above, but is only limited by the claims.

BRIEF DESCRIPTION OF THE DRAWINGS

The features, aspects, and advantages of the present invention will become more fully apparent from the following description, appended claims, and accompanying drawings in which:

DETAILED DESCRIPTION OF THE PREFERRED EMBODIMENT

Figure 1:
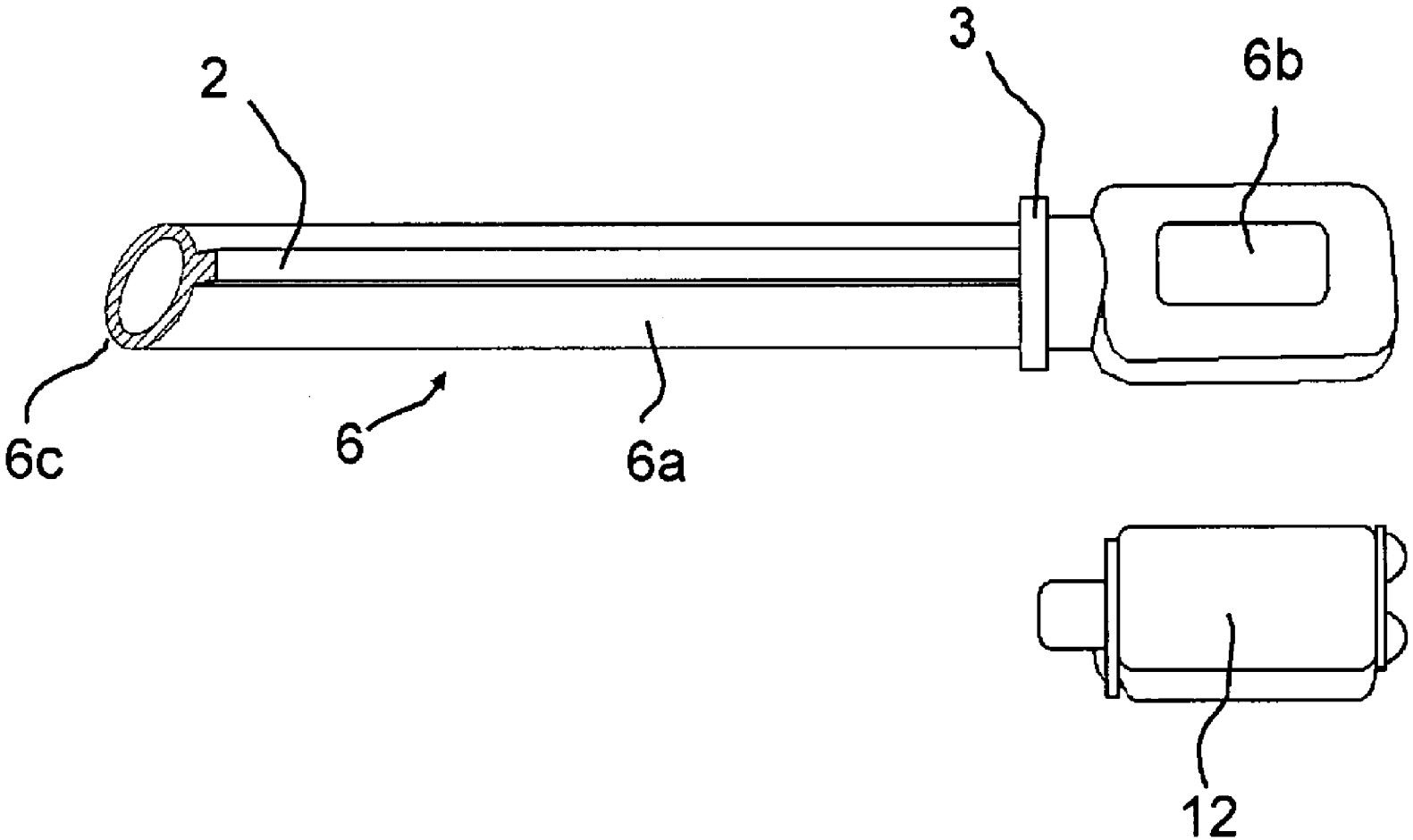
FIG. 1 is a plan view of an exemplary embodiment of an electronic assembly tube of the present invention.

Referring now to FIG. 1, an electronic assembly tube 6 comprises a substantially tubular pathway 6*a* and an assembly receptacle 6*b*. In a currently preferred embodiment, the assembly receptacle 6*b* is in fluid communication with the tubular pathway 6*a*. The assembly receptacle 6*b* is sized to receive the electronic assembly 12.

Electronic assembly 12 comprises components which process received sound to provide processed sound for output into an ear canal of a hearing instrument user, e.g. a receiver. In a preferred embodiment, electronic assembly 12 is an electromechanical receiver as will be familiar to those of ordinary skill in the hearing instrument arts. In alternative embodiments, electronic assembly 12 may further comprise additional electronic components such as filters; active devices, and the like. The tubular pathway 6*a* carries the processed sound from the electronic assembly 12 to the outside 16 of the housing 11.

A barrier stopper 3 is located at a predetermined position along an exterior portion of the tubular pathway 6*a*. In a preferred embodiment, the barrier stopper 3 is a ring shaped stopper integral with an outer portion of the tubular pathway 6*a*. In alternative embodiments, the barrier stopper 3 may be a component separate from the tubular pathway 6*a* and can be mounted or otherwise attached to the tubular pathway 6*a* at a predetermined position along the tubular pathway 6*a* such as prior to insertion of the electronic assembly tube 6 and the electronic assembly 12 within the chamber 1 (FIG. 2).

Additionally, a spline 2 is present along a predetermined length of the tubular pathway 6*a*. In a preferred embodiment, the spline 2 is a ridge or elevation formed in a predetermined portion of the electronic assembly tube 6 such as along an outside portion of the tubular pathway 6.

Figure 2:
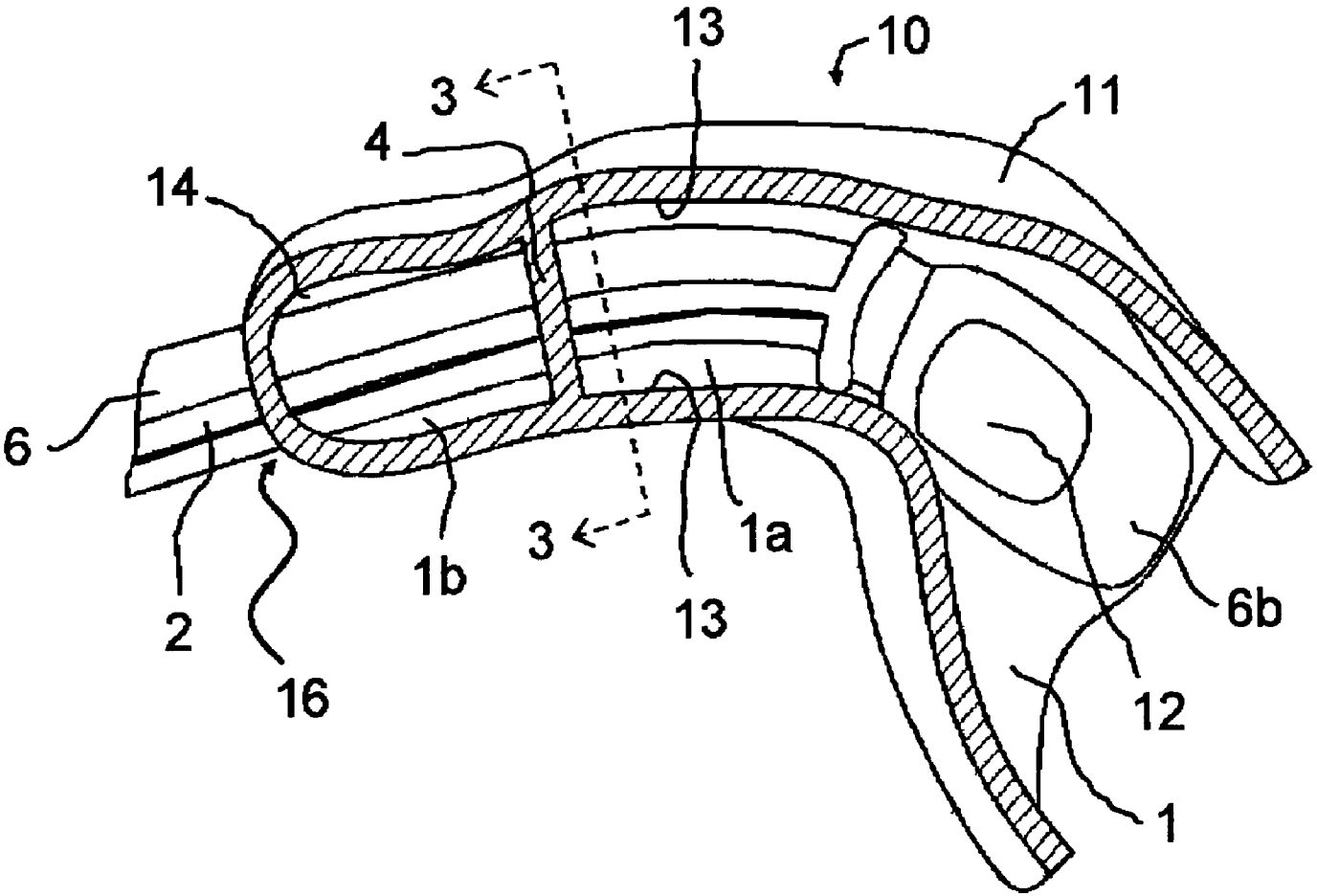
FIG. 2 is a partial cutaway view in partial perspective of an exemplary embodiment of a hearing instrument showing an electronic assembly tube partially inserted into a hearing instrument shell.

Referring now to FIG. 2, hearing instrument 10 comprises housing 11 into which the electronic assembly tube 6 and electronic assembly 12 may be placed.

The housing 11 further comprises a chamber 1, comprising inner surfaces 13. The chamber 1 is sized to accommodate the electronic assembly tube 6, including the assembly receptacle 6*b*.

A barrier 4, e.g., a shoulder or ridge within the chamber 1, is disposed within a predetermined portion of the chamber 1 proximate the distal end 14 of chamber 1. The barrier 4 divides the chamber 1 into two sections, 1*a* and 1*b*. A guide channel 5 (see FIG. 3) in the barrier 4 permits the electronic assembly tube 6 to pass through the barrier 4. In a currently envisioned alternative embodiment, either or both of sections 1*a* and 1*b* may be at least partially filled with a predetermined filler material.

The barrier 4 further defines a structure for locating and positioning the electronic assembly tube 6 and the electronic assembly 12 within the chamber 1. It restricts movement of the electronic assembly tube 6 and, in turn, the electronic assembly 12 within the housing 11.

Figure 3:
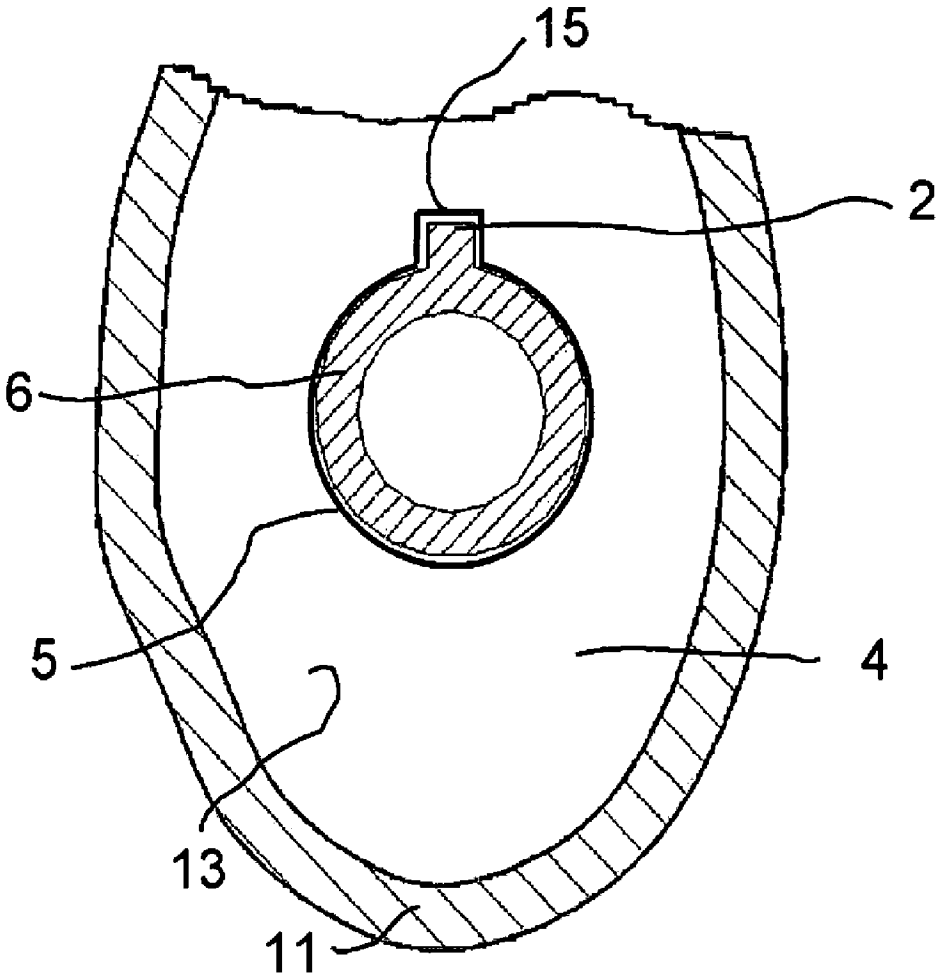
FIG. 3 is a partial cross-sectional view of the hearing instrument of FIG. 2.

Referring now to FIG. 3, the guide channel 5 comprises a keyway 15 that mates with the spline 2 on the tubular pathway 6*a*. The spline 2 fixes the orientation of the electronic assembly tube 6 and the electronic assembly 12 (FIG. 2) in the chamber 1.

Figure 4:
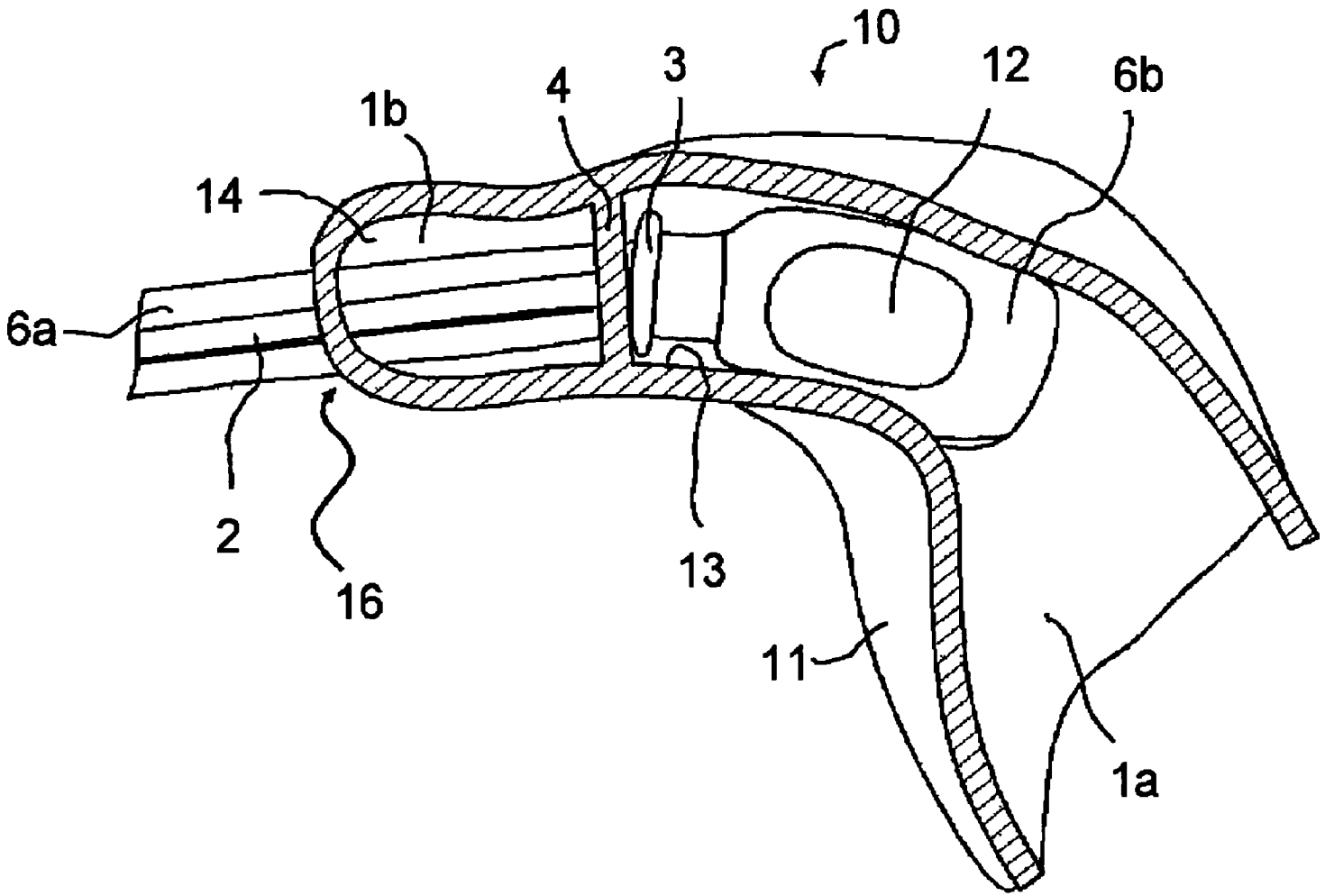
FIG. 4 is a partial cutaway view in partial perspective of an exemplary embodiment of a hearing instrument showing an electronic assembly tube more fully inserted into a hearing instrument shell.

Referring now to FIG. 4, the electronic assembly tube 6 is drawn through the guide channel 5 until the barrier stopper 3 meets the barrier 4, at which point the assembly receptacle 6*b* will have reached a position within the section 1*a* at a predetermined distance from the barrier 4.

Figure 5:
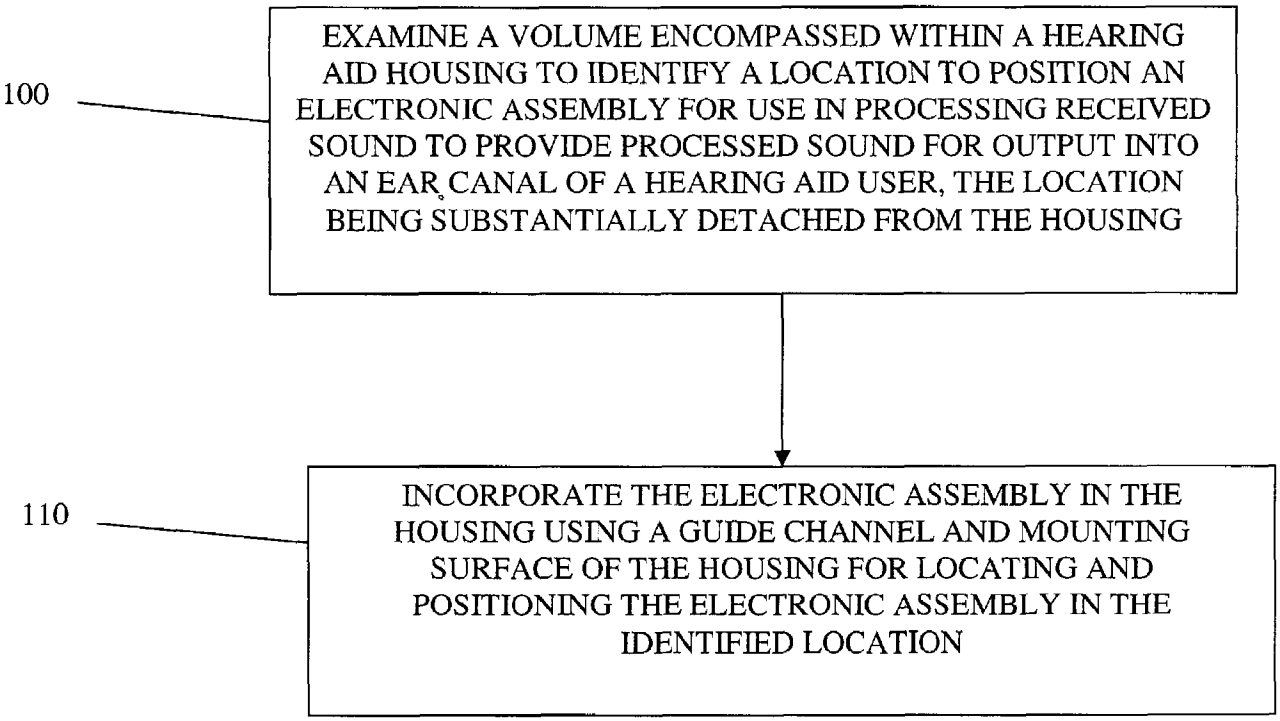
FIG. 5 is a flowchart of an exemplary method of manufacturing an exemplary embodiment of a hearing instrument.

In the operation of an exemplary embodiment, referring now to FIG. 5, spacing within housing 11 (FIG. 2), such as the volume defined by inner surfaces 13 (FIG. 2) of chamber 1 (FIG. 2), may be examined, step 100, and analyzed, e.g. with software, to create a desired dimension with respect to chamber 1 (FIG. 2) and assembly receptacle 6*b* (FIG. 1) which will contain electronic assembly 12 (FIG. 1) such as to achieve a desired audio quality. Dimensions of chamber 1, e.g. characteristics of inner surfaces 13 (FIG. 2) and placement of barrier 4 (FIG. 2) to form sections 1*a* and 1*b* (FIG. 2), may then be determined for a desired positioning of electronic assembly 12 (FIG. 1) by providing required gaps between inner surfaces 13 of chamber 1 and an outside surface of assembly receptacle 6*b* (FIG. 1). These dimensions may also include characteristics of barrier 4 (FIG. 2), e.g. an offset from distal end 14 (FIG. 2) to an edge of barrier 4 which will contact barrier stopper 3 (FIG. 1). Desired positioning may be an optimum positioning, based on predetermined criteria.

Guide channel 5 (FIG. 3) may also be formed or otherwise manufactured in chamber 1 (FIG. 2) and/or barrier 4 (FIG. 2) to aid in providing a desired positioning of assembly receptacle 6*b* (FIG. 1) in chamber 1.

When hearing instrument 10 (FIG. 2) is assembled, the electronic assembly 12 (FIG. 1) is inserted into the assembly receptacle 6*b* (FIG. 1) prior to insertion of the electronic assembly tube 6 into the chamber 1 (FIG. 1), step 110. The tubular pathway 6*a* (FIG. 1) and the assembly receptacle 6*b* (FIG. 1) may be manufactured with the barrier stopper 3 formed as part of or integral with the tubular pathway 6*a* at a predetermined offset from the assembly receptacle 6*b* (FIG. 1). Alternatively, the barrier stopper 3 (FIG. 1) may be added to the tubular pathway 6*a* at a predetermined offset from the assembly receptacle 6*b* (FIG. 1).

After the electronic assembly 12 (FIG. 1) is placed within the assembly receptacle 6*b* the insertion end 6*c* (FIG. 1) of the electronic assembly tube 6 (FIG. 1) is inserted into and drawn through the guide channel 5 (FIG. 4). As previously noted, the spline 2 (FIG. 1) mates with the keyway 15 of the guide channel 5 (FIG. 3) and the electronic assembly tube 6 is drawn further into the chamber 1 (FIG. 4) until the barrier stopper 3 (FIG. 4) reaches a predetermined position inside the chamber 1 (FIG. 4) i.e., the barrier 4 (FIG. 4).

After the electronic assembly tube 6 (FIG. 1) and the electronics assembly 12 (FIG. 1) are placed in the chamber 1 (FIG. 4), and additional required components may be added, e.g., a battery, battery contacts, additional electronics, a battery door, and the like, or combinations thereof. The housing 11 (FIG. 2) may then be closed.

It will be understood that various changes in the details, materials, and arrangements of the parts which have been described and illustrated above in order to explain the nature of this invention may be made by those skilled in the art without departing from the principle and scope of the invention as recited in the following claims.

What is claimed is:

1. A hearing instrument for positioning in the ear of a user, comprising:

an electronic assembly for providing received sound to the ear canal of the user, where the electronic assembly comprises an electronic assembly tube comprising a spline; and a housing sized to fit within the ear of the user and comprising a chamber for containing the electronic assembly; and barrier means for locating and positioning the electronic assembly within the chamber, where the barrier means for locating and positioning comprises an internal guide channel, the guide channel comprising a keyway that mates with the spline.

2. A hearing instrument according to claim 1, where the electronic assembly tube comprises means for carrying sound generated by the electronic assembly to the outside of the housing.

3. A hearing instrument according to claim 2, where the means for carrying sound generated by the electronic assembly to the outside of the housing further comprises a tubular pathway.

4. A hearing instrument according to claim 1, where the electronic assembly tube further comprises an assembly receptacle for electronic assembly.

5. A hearing instrument for insertion into the ear of a user, the ear comprising an ear canal, comprising:

a housing sized to fit within the ear of the user, comprising a chamber;

an electronic assembly for generating sound for the ear canal of the user, where the electronic assembly is positioned in the chamber;

an electronic assembly tube comprising means for carrying sound generated by the electronic assembly to the outside of the housing:

a barrier positioned within the chamber and comprising a guide channel that accommodates the electronic assembly tube; and a barrier stopper disposed on the electronic assembly tube between the electronic assembly and the barrier, at a predetermined distance from the electronic assembly.

6. A hearing instrument according to claim 5, where the electronic assembly tube comprises an outer surface, and the barrier stopper comprises at least one of:

a stopper ring disposed about the outer surface of the electronic assembly tube; or an elevation integral with an electronic assembly tube disposed about the outer surface of the electronic assembly tube.

7. A hearing instrument according to claim 5, where the barrier comprises a wall, shoulder, or ridge formed in the chamber.

8. A hearing instrument according to claim 7, where the barrier means divides the chamber into a plurality of sections and at least one of the sections is at least partially filled with a filler material.

9. A hearing instrument according to claim 5, where the electronic assembly tube comprises a locating spline and the guide channel comprises a keyway conforming to the spline.

10. A hearing instrument according to claim 5, where the means for carrying sound generated by the electronic assembly to the outside of the housing further comprises a tubular pathway.

11. A hearing instrument according to claim 10, where the electronic assembly tube further comprises an assembly receptacle for the electronic assembly; and means for allowing the passage of sound between the assembly receptacle and the tubular pathway.

12. A hearing instrument according to claim 5, where the electronic assembly tube further comprises an assembly receptacle for electronic assembly.

13. A hearing instrument according to claim 5, where the barrier means divides the chamber into a plurality of sections.

14. A hearing instrument for insertion into the ear of a user, the ear comprising an ear canal, comprising:

a housing sized to fit within the ear of the user, comprising a chamber;

an electronic assembly for generating sound for the ear canal of the user, where the electronic assembly is positioned in the chamber;

an electronic assembly tube comprising an assembly receptacle for the electronic assembly; and means for carrying sound generated by the electronic assembly to the outside of the housing;

a barrier positioned within the chamber and comprising a guide channel that accommodates the electronic assembly tube; and a barrier stopper disposed on the electronic assembly tube between the electronic assembly and the barrier, at a predetermined distance from the electronic assembly.

* * * * *